US006879294B2

(12) United States Patent
Yuanzhu

(10) Patent No.: US 6,879,294 B2
(45) Date of Patent: Apr. 12, 2005

(54) DUAL ANTENNA CAPABLE OF TRANSMITTING AND RECEIVING CIRCULARLY POLARIZED ELECTROMAGNETIC WAVE AND LINEARLY POLARIZED ELECTROMAGNETIC WAVE

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 40 days.

(21) Appl. No.: 10/417,491

(22) Filed: Apr. 17, 2003

(65) Prior Publication Data

US 2003/0197651 A1 Oct. 23, 2003

(30) Foreign Application Priority Data

Apr. 17, 2002 (JP) ..... 2002-114974

(51) Int. Cl.[7] ..... H01Q 1/28; H01Q 5/01
(52) U.S. Cl. ..... 343/725; 343/713
(58) Field of Search ..... 343/711, 713, 343/700 MS, 725, 900, 904

(56) References Cited

U.S. PATENT DOCUMENTS 5,300,936 A * 4/1994 Izadian ..... 343/700 MS
5,610,620 A 3/1997 Stites et al.
5,831,577 A 11/1998 Nichols et al.
6,313,801 B1 11/2001 Sanford et al.

FOREIGN PATENT DOCUMENTS

DE 295 00 961 U 7/1995
EP 0 590 955 A3 4/1994
EP 0 862 239 A1 9/1998
JP Hei 10-107542 4/1998

* cited by examiner

*Primary Examiner*—James Vannucci
(74) *Attorney, Agent, or Firm*—Brinks Hofer Gilson & Lione

(57) ABSTRACT

A direction of a power feed patch relative to a rod-shaped antenna is set so that a short axis thereof substantially orthogonally crosses a plane containing an intersection between the short axis and a long axis of the power feed patch of a patch antenna and an axis of the rod-shaped antenna. As a plane of polarization of a linearly polarized electromagnetic wave radiated from the rod-shaped antenna is thereby caused to substantially coincide with a direction of the long axis of the power feed patch and to substantially orthogonally cross a direction of the short axis, even if a powerful wave of a higher frequency than a desired frequency to be received by the patch antenna and difficult to be removed by a band pass filter of a low-noise amplifier circuit is radiated from the rod-shaped antenna, field components of the high frequency electromagnetic wave in the direction of the short axis will become virtually zero.

3 Claims, 2 Drawing Sheets

DUAL ANTENNA CAPABLE OF TRANSMITTING AND RECEIVING CIRCULARLY POLARIZED ELECTROMAGNETIC WAVE AND LINEARLY POLARIZED ELECTROMAGNETIC WAVE

This application claims the benefit of priority to Japanese Patent Application 2002-114974, filed on Apr. 17, 2002.

BACKGROUND OF THE INVENTION

1. Field of the Invention

The present invention relates to a dual antenna unitized by installing in parallel a patch antenna capable of transmitting and receiving a circularly polarized electromagnetic wave to and from a Global Positioning System (GPS) satellite or the like and a rod-shaped antenna capable of transmitting and receiving a linearly polarized electromagnetic wave for use in mobile telephony or the like.

2. Description of the Related Art

Vehicle-mountable patch antennas have been known since years ago as means for finding one's current geographical position by receiving an electromagnetic wave from a GPS satellite, and more recently vehicle-mountable dual antennas, each combining a rod-shaped antenna for mobile telephone use with a patch antenna for GPS use, have become available for practical use. Such a dual antenna has a common radome compactly housing a patch antenna and a rod-shaped antenna. As it can be handled as a relatively small antenna unit combining the function to receive a circularly polarized electromagnetic wave from a GPS satellite and a function to receive a linearly polarized electromagnetic wave for use in mobile telephony, the dual antenna is expected to find use in many different areas along with the development and expansion of information and communication services.

FIG. 4 shows a plan of such a dual antenna according to the prior art, in which the illustration of its radome is dispensed with. As illustrated, in a known dual antenna 1, a patch antenna 3 and a rod-shaped antenna 4 are provided in parallel on a base plate 2, and these two antennas 3 and 4 receive power supply via cables 5 and 6 and connectors (not shown).

To schematically describe its configuration, the patch antenna 3 is fabricated by providing a power feed patch 7, which is a radiation element of a microstrip structure, over a dielectric substrate 8, mounting this dielectric substrate 8 on a circuit board 9, and packaging components of a low-noise amplifier circuit (not shown; including an amplifier and a band pass filter), covered by a shield case, on the bottom side of the circuit board 9. For the power feed patch 7, a short axis 7*a* having a smaller resonance length matching a higher resonance frequency (f1) mode and a long axis 7*b* having a greater resonance length matching a lower resonance frequency (f2) mode are defined by providing degenerate separating elements such as notches or projections, and the short axis 7*a* and the long axis 7*b* orthogonally cross each other. Excitation at a frequency between these high and low resonance frequencies f1 and f2 to generate a 90-degree phase difference between the radiation fields in the two modes can make the composite radiation field a circular polarization. This enables a circularly polarized electromagnetic wave of 1.575 GHz transmitted from a GPS satellite to be received by the patch antenna 3. When it is received, of the electromagnetic wave higher in frequency than the resonance frequency f1, field components mainly in the direction of the short axis 7*a* are received and, of the electromagnetic wave lower in frequency than the resonance frequency f2, field components mainly in the direction of the long axis 7*b* are received. To add, as the power feed patch 7 is connected to a low-noise amplifier circuit via a power feed pin 10, signals received by the power feed patch 7 are delivered to a GPS receiver circuit (not shown) via the cable 5 and the like in a state in which they have been amplified by the amplifier and cleared of signals in the undesired frequency band by a band pass filter.

On the other hand, the rod-shaped antenna 4 is fixed to a circuit board 11 adjoining the patch antenna 3, and erected in a slightly inclined state. This rod-shaped antenna 4 can transmit and receive electromagnetic waves of the 850 MHz band and the 1.85 GHz band used for mobile telephony, and is connected to a transmitter/receiver (not shown) via the cable 6 and the like. The radome (not shown) is formed in such a shape as covers the patch antenna 3 and the rod-shaped antenna 4 and fixed to the base plate 2.

Incidentally, in the GPS reception unit of the dual antenna of the example of the prior art described above, if any undesired signal whose frequency is other than that of the desired receive signal is received by the patch antenna 3, this undesired signal is usually removed by the band pass filter, and therefore it rarely interferes with the desired signal. However, if this undesired signal is a powerful electromagnetic wave for mobile telephony radiating from the adjoining rod-shaped antenna 4, there may arise a problem that the low-noise amplifier circuit is saturated with signals and invite interference.

SUMMARY OF THE INVENTION

An object of the present invention, attempted in view of this problem with the prior art, is to provide a highly reliable dual antenna made less susceptible to the adverse effect of the electromagnetic wave radiating from its rod-shaped antenna on an adjoining patch antenna.

In order to achieve the object stated above, a dual antenna according to the invention is provided with a patch antenna having a power feed patch disposed over a dielectric substrate and capable of transmitting and receiving a circularly polarized electromagnetic wave and a rod-shaped antenna erected in the vicinity of the patch antenna and capable of transmitting and receiving a linearly polarized electromagnetic wave, wherein the power feed patch is formed by causing a short axis whose resonance length is set smaller and a long axis whose resonance length is set greater to orthogonally cross each other, and a direction of the power feed patch relative to the rod-shaped antenna is set so that the short axis substantially orthogonally crosses a plane containing an intersection between the short axis and long axis and an axis of the rod-shaped antenna. More specifically, it is preferable to set an angle formed by the plane and the short axis within a range of 85 degrees to 95 degrees.

In the dual antenna configured in this manner, since the plane of polarization of the linearly polarized electromagnetic wave radiated from the rod-shaped antenna substantially coincides with the direction of the long axis of the power feed patch and substantially orthogonally crosses the direction of the short axis, even if a powerful wave of a higher frequency than the desired frequency to be received by the patch antenna is radiated from the rod-shaped antenna, that high frequency electromagnetic wave will have almost no field component in the direction of the short axis, and accordingly will hardly be received by the patch antenna. Or if a powerful wave of a lower frequency than the desired frequency to be received by the patch antenna is radiated from the rod-shaped antenna, as the plane of polarization of that low frequency electromagnetic wave substantially coincides with the direction of the long axis, it will be received by the patch antenna, but can be readily removed by the band pass filter of a low-noise amplifier circuit. Therefore, the patch antenna of this dual antenna, even if a linearly polarized powerful electromagnetic wave for mobile telephony use is radiated from an adjoining rod-shaped antenna, is hardly susceptible to jamming and can receive, always in a satisfactory state, the circularly polarized relatively weak electromagnetic wave transmitted from the GPS satellite or the like.

BRIEF DESCRIPTION OF THE DRAWINGS

FIG. 2 shows a plan of the dual antenna, in which the illustration of its radome is dispensed with;

FIG. 4 shows a plan of the dual antenna according to the prior art, in which the illustration of its radome is dispensed with.

DETAILED DESCRIPTION OF THE PREFERRED EMBODIMENT

Figure 1:
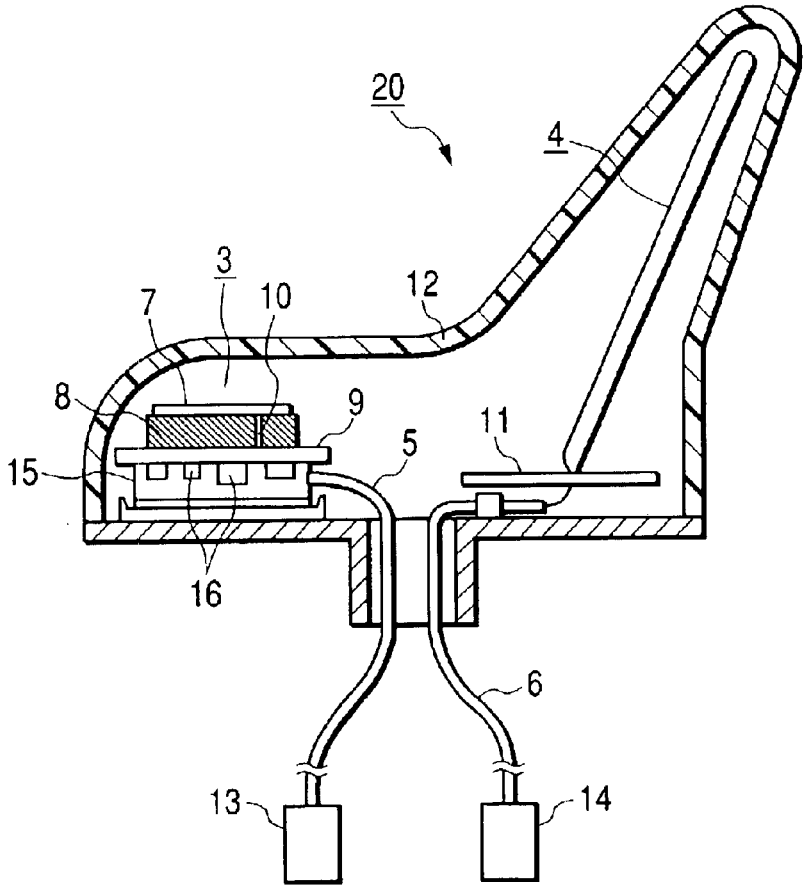
FIG. 1 shows a schematic section of a dual antenna, which is a preferred embodiment of the present invention.
Figure 2:
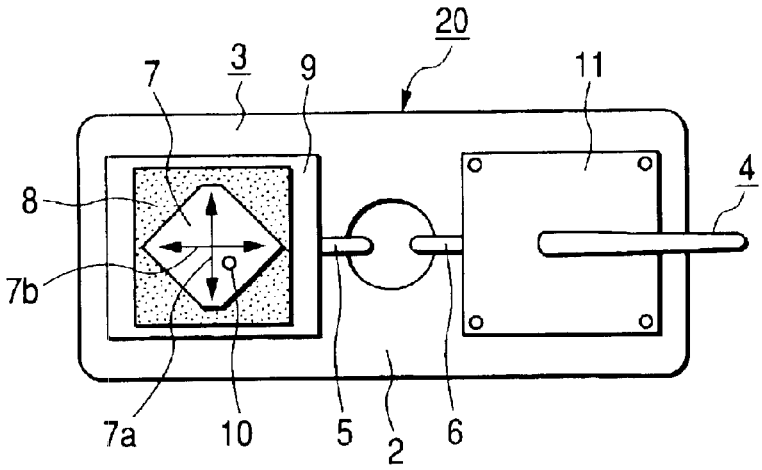
Figure 3:
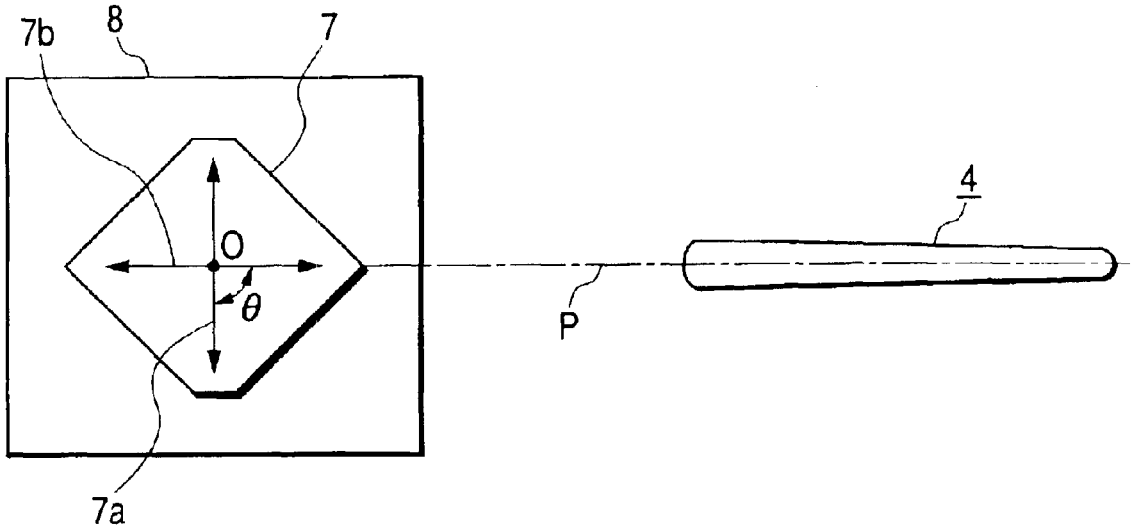
FIG. 3 is a drawing for describing the positional relationship between the patch antenna and the rod-shaped antenna in the dual antenna.
Figure 4:
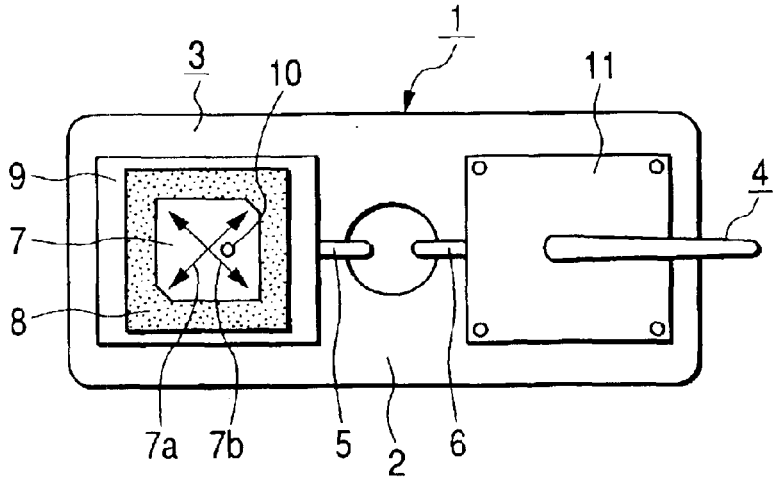
FIG. 4 PRIOR ART

To describe a preferred embodiment of the present invention with reference to accompanying drawings, FIG. 1 shows a schematic section of a dual antenna, which is the preferred embodiment of the invention; FIG. 2, a plan of the dual antenna, in which the illustration of its radome is dispensed with; and FIG. 3, a drawing for describing the positional relationship between the patch antenna and the rod-shaped antenna in the dual antenna. Elements having counterparts in FIG. 4 are denoted by respectively the same reference signs.

A dual antenna 20 shown in FIGS. 1 and 2 is a vehicle-mountable compact antenna unit which has, over a base plate 2, a patch antenna 3 for receiving a circularly polarized electromagnetic wave from a GPS satellite, a rod-shaped antenna 4 for transmitting and receiving a linearly polarized electromagnetic wave for mobile telephony, the two antennas 3 and 4 being disposed in parallel and housed in a common radome 12. The patch antenna 3 is supplied with power via a cable 5 and a connector 13, and the rod-shaped antenna 4, via a cable 6 and a connector 14. In this-embodiment of the invention, the relative positions of these two antennas 3 and 4 are significantly different from their counterparts according to the prior art.

The schematic configuration is such that the patch antenna 3 has a power feed patch 7, which is a radiation element of a microstrip structure provided over a dielectric substrate 8; this dielectric substrate 8 is mounted over a circuit board 9, and low-noise amplifier circuit components 16 including an amplifier and a band pass filter, all covered by a shield case 15, are packaged on the bottom face of the circuit board 9. In the power feed patch 7, a short axis 7*a* matching a mode (f1) of a higher resonance frequency and a long axis 7*b* matching a mode (f2) of a lower resonance frequency orthogonally cross each other, and excitation at a frequency between these high and low resonance frequencies f1 and f2 to generate a 90-degree phase difference between the radiation fields in the two modes can make the composite radiation field a circular polarization. This enables a circularly polarized electromagnetic wave of 1.575 GHz transmitted from a GPS satellite to be received by the patch antenna 3. When it is received, of the electromagnetic wave higher in frequency than the resonance frequency f1, field components mainly in the direction of the short axis 7*a* are received and, of the electromagnetic wave lower in frequency than the resonance frequency f2, field components mainly in the direction of the long axis 7*b* are received. To add, as this power feed patch 7 is connected to a low-noise amplifier circuit via a power feed pin 10, signals received by the power feed patch 7 are delivered to a GPS receiver circuit (not shown) via the cable 5 and the connector 13 in a state in which they have been amplified by the amplifier and cleared of signals in the undesired frequency band by a band pass filter.

On the other hand, the rod-shaped antenna 4 is fixed to a circuit board 11 adjoining the patch antenna 3, and erected in a slightly inclined state. This rod-shaped antenna 4 can transmit and receive electromagnetic waves of the 850 MHz band and the 1.85 GHz band used for mobile telephony, and is connected to a transmitter/receiver circuit via the cable 6 and the connector 14. The radome 12 (not shown) is fixed to the base plate 2, and covers internal component elements including the patch antenna 3 and the rod-shaped antenna 4.

To describe the positional relationship between the patch antenna 3 and the rod-shaped antenna 4, as shown in FIG. 2, their relative positions are set so that the short axis 7*a* substantially orthogonally crosses a plane containing the intersection between the short axis 7*a* and the long axis 7*b* of the power feed patch 7 and the axis of the rod-shaped antenna 4. More specifically, as shown in FIG. 3, the angle θ formed by a plane P to the intersection O between the short axis 7*a* and the long axis 7*b* of the power feed patch 7 of the rod-shaped antenna 4 can be set within the range of $85° \leqq \theta \leqq 95°$.

In the dual antenna 20 configured in this manner, since the plane of polarization of the linearly polarized electromagnetic wave radiated from the rod-shaped antenna 4 substantially coincides with the direction of the long axis 7*b* of the power feed patch 7 and substantially orthogonally crosses the direction of the short axis 7*a*, even if a powerful wave of a higher frequency than the desired frequency to be received by the patch antenna 3 (1.575 GHz) is radiated from the rod-shaped antenna 4, that high frequency electromagnetic wave will have almost no field component in the direction of the short axis 7*a*, and accordingly will hardly be received by the patch antenna 3. Or if a powerful wave of a lower frequency than the desired frequency to be received by the patch antenna 3 is radiated from the rod-shaped antenna 4, as the plane of polarization of that low frequency electromagnetic wave substantially coincides with the direction of the long axis 7*b*, it will be received by the patch antenna 3, but can be readily removed by the band pass filter, which is one of the low-noise amplifier circuit components 16. Therefore, the patch antenna 3 of this dual antenna 20, even if a linearly polarized powerful electromagnetic wave for mobile telephony use is radiated from the adjoining rod-shaped antenna 4, is hardly susceptible to jamming and can receive, always in a satisfactory state, the circularly polarized relatively weak electromagnetic wave transmitted from the GPS satellite.

To add, although the embodiment of the invention described above is supposed to use the patch antenna 3 for receiving a circularly polarized electromagnetic wave from a GPS satellite and the rod-shaped antenna 4 for transmitting and receiving a linearly polarized electromagnetic wave for mobile telephony use, the invention can obviously be applied to cases in which the patch antenna 3 and the rod-shaped antenna 4 are used for other purposes.

The present invention can be carried out in the mode so far described and provide the following advantages.

As this is a dual antenna in which the direction of the power feed patch relative to the rod-shaped antenna is set so that the short axis substantially orthogonally crosses the plane containing the intersection between the short axis and the long axis of the power feed patch and the axis of the rod-shaped antenna, and the plane of polarization of the linearly polarized electromagnetic wave radiated from the rod-shaped antenna substantially coincides with the direction of the long axis of the power feed patch and substantially orthogonally crosses the direction of the short axis, even if a powerful wave of a higher frequency than the desired frequency to be received by the patch antenna is radiated from the rod-shaped antenna, that high frequency electromagnetic wave will hardly be received by the patch antenna. Or if a powerful wave of a lower frequency than the desired frequency to be received by the patch antenna is radiated from the rod-shaped antenna, that low frequency electromagnetic wave will be received by the patch antenna, but can be readily removed by the band pass filter of the low-noise amplifier circuit. Therefore, the patch antenna of this dual antenna, even if a linearly polarized powerful electromagnetic wave for mobile telephony use is radiated from the adjoining rod-shaped antenna, is hardly susceptible to jamming and can receive, always in a satisfactory state, the circularly polarized relatively weak electromagnetic wave transmitted from the GPS satellite or the like, promising a high level of reliability.

What is claimed is:

1. A dual antenna comprising:

a patch antenna having a power feed patch disposed over a dielectric substrate and configured to transmit and receive a circularly polarized electromagnetic wave; and a rod-shaped antenna erected a predetermined distance from the patch antenna and configured to transmit and receive a linearly polarized electromagnetic wave, wherein the power feed patch has a short axis and a long axis, the short axis having a resonance length smaller than that of the long axis, the short axis and long axis orthogonally crossing each other, and wherein a direction of the power feed patch relative to the rod-shaped antenna is set so that the short axis substantially orthogonally crosses a plane, the plane containing an intersection between the short axis and long axis and an axis of symmetry of the rod-shaped antenna.

2. The dual antenna according to claim 1, wherein an angle formed by the plane and the short axis is set within a range of 85 degrees to 95 degrees.

3. The dual antenna according to claim 1, wherein the rod-shaped antenna is inclined with respect to the plane containing the intersection between the short axis and long axis and the axis of symmetry of the rod-shaped antenna.

* * * * *